US005161956A

United States Patent [19]

Fiedler

[11] Patent Number: 5,161,956

[45] Date of Patent: Nov. 10, 1992

[54] VALVE PUMP

[75] Inventor: Robert R. Fiedler, Lincoln, Nebr.

[73] Assignee: Isco, Inc., Lincoln, Nebr.

[21] Appl. No.: 522,679

[22] Filed: May 11, 1990

[51] Int. Cl.[5] ..... F04B 23/14

[52] U.S. Cl. ..... 417/86; 417/118; 417/126

[58] Field of Search ..... 417/86, 118, 121, 122, 417/126, 139, 478

[56] References Cited

U.S. PATENT DOCUMENTS

| | | | |
|---|---|---|---|
| 3,324,803 | 6/1967 | Kelley et al. | 417/126 |
| 3,408,949 | 11/1968 | Hart, Jr. | 417/126 |
| 4,050,854 | 9/1977 | Hereford et al. | 417/126 |
| 4,701,107 | 10/1987 | Dickinson et al. | 417/86 |
| 4,749,337 | 6/1988 | Dickinson et al. | 417/394 |
| 4,810,172 | 3/1989 | Fielder et al. | 417/478 |
| 4,886,432 | 12/1989 | Kimberlin | 417/478 |

*Primary Examiner*—Richard A. Bertsch
*Assistant Examiner*—Michael I. Kocharov
*Attorney, Agent, or Firm*—Vincent L. Carney

[57] ABSTRACT

To provide smoother operation of a gas-operated purge pump, the pump housing receives a standpipe closed by a low-density, floatable check valve element at the inlet of a standpipe within the housing. Periodically, at timed intervals, air is forced through an air conduit into the housing. If there is liquid in the housing, a check valve element floats upwardly because it is less dense than the liquid and mounted for movement to and away from the valve seat. While it is off of the valve seat, the air forces water into the standpipe and it moves upwardly until the chamber of the tubular pump housing is free of the liquid, at which time the check valve drops back into position and seats to prevent further flow of liquid. Upon termination of the pumping of gas pressure, the check valve in the pump housing inlet is free to move under the pressure of water in the well and the pump housing chamber again fills with fluid, causing the valve element to lift and permitting flow of water into the standpipe.

8 Claims, 3 Drawing Sheets

VALVE PUMP

BACKGROUND OF THE INVENTION

This invention relates to pumps and more particularly to gas-operated liquid pumps such as for example pumps of the type referred to as well water purge pumps.

One class of pumps includes a tubular pump housing, a liquid inlet, a standpipe and an air conduit. The pump housing is sealed at two ends except: (1) there is a liquid inlet at one end controlled by a check valve so that liquid may flow into the housing such as from a well but not out of the housing back into the well through the inlet; (2) the standpipe extends downwardly into the housing and there is a check valve in the standpipe; and (3) the air conduit enters the housing. With this arrangement, water flows into the housing through the inlet and then air is pumped into the housing to force the liquid upwardly through the standpipe.

In a prior art pump of this type, air is pumped into the pump housing to force water up through the standpipe to the surface. The user learns when the pump housing is empty of water by the presence of water being pumped from the standpipe followed by air or by the volume of water pumped from the standpipe. When the pump housing is empty, more water is permitted to enter and the cycle repeated until sufficient water has been pumped from the well. For example, in a purging operation of the well, a number of volumes of the well specified by the Enviromental Protection Agency is removed.

This prior art pump has a disadvantage in that air separates slugs of water moving up the standpipe to cause waste time as slugs of water are expelled separated by slugs of air.

SUMMARY OF THE INVENTION

Accordingly, it is an object of the invention to provide a novel valved pump.

It is a further object of the invention to provide a novel purge pump.

It is a further object of the invention to provide a novel technique for using gases to pump water through a pump.

It is a still further object of the invention to provide a novel technique for purging wells.

It is a still further object of the invention to provide a novel valving arrangement for pumps.

In accordance with the above and further objects of the invention, a pump includes a housing, a housing inlet, a housing-inlet check valve, a gas source, a standpipe and a valve arrangement that opens upon sensing water and closes upon sensing air. The valve arrangement includes a standpipe check valve located at the inlet of the standpipe within the housing. The standpipe check valve arrangement prevents flow from the standpipe into the housing and includes a valve element which permits liquid to flow into the standpipe when there is liquid in the housing but closes once the liquid is removed so that, upon pressurization of the housing by the gas source, liquid flows into the standpipe and may be pumped from the housing to the surface for discharge. With this arrangement, pressurized gas may continually force liquid into the standpipe to evacuate the housing but once the housing is empty of liquid, the standpipe is blocked within the housing so that gas does not enter the standpipe.

In operation, the housing may be lowered into a well. Within the well, water flows into the housing through the inlet but is not able to flow out of the housing back into the well because of a check valve biased to permit inward flow of water but not outward flow of water.

Periodically, at timed intervals, gas such as air under pressure is forced through an air conduit into the housing. In the preferred embodiment, if there is liquid in the housing, a check valve element of the means for sensing liquids floats upwardly because it is less dense than the liquid and mounted for movement to and away from the valve seat. While the valve element is off of the valve seat, the pressurized gas forces water into the standpipe and it moves upwardly until the chamber of the tubular pump housing is free of the liquid, at which time the check valve drops back into position and seats on the valve seat to prevent further flow of liquid. Upon release of the gas pressure, the check valve in the pump housing inlet is free to move under the pressure of water in the well and the pump housing chamber again fills with water, causing the valve element to lift and permitting flow of water into the standpipe.

The standpipe check valve arrangement should include: (1) a floatable means of lower density than the liquid being pumped which, when there is liquid in the housing, permits the liquid to enter the standpipe and when the pump housing chamber is evacuated of liquid, closes to block any substantial air from entering the standpipe; and (2) a second check valve positioned so that the standpipe remains full of liquid and does not drain back into the housing. This can conveniently be accomplished by two members, which are: (1) a check valve to prevent liquid from flowing out of the standpipe once it has entered; and (2) a floatable check valve element and cooperating valve seat that opens when the pump chamber is full of liquid of greater density than the valve element.

From the above description, it can be understood that the pump of this invention has several advantages such as: (1) it is faster in operation since the cycle time is increased by avoiding the upward movement of air in the standpipe; and (2) it avoids the wasting of compressed air or other gas by preventing its escape from the outlet of the standpipe at the surface.

SUMMARY OF THE DRAWINGS

The above noted and other features of the invention will be better understood from the following detailed description when considered with reference to the accompanying drawings in which.

DETAILED DESCRIPTION

Figure 1:
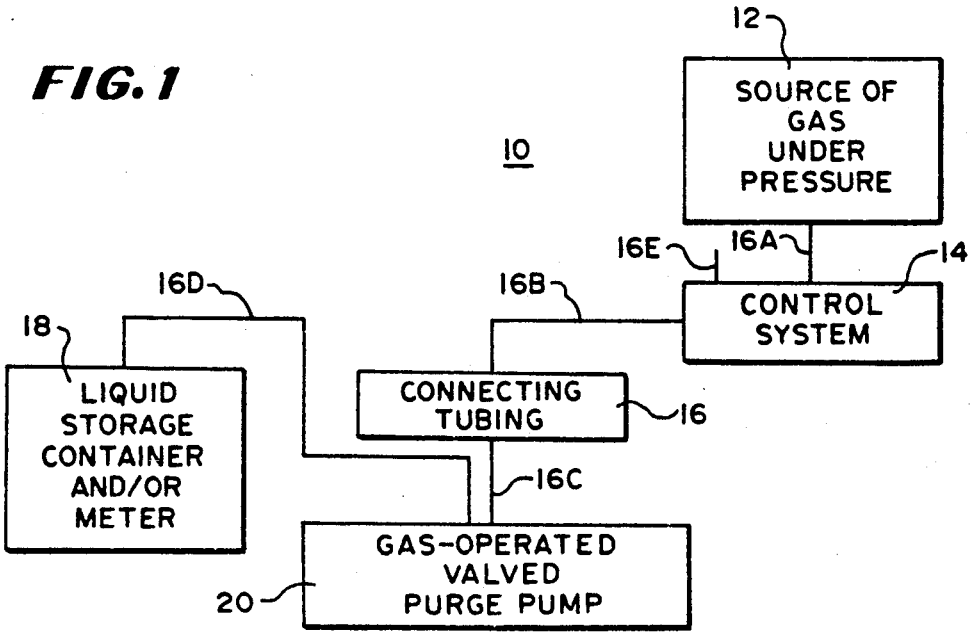
FIG. 1 is a block diagram of a pumping system in accordance with the invention.

In FIG. 1, there is shown a pumping system 10 having a source of gas under pressure 12, a control system 14, certain connecting tubing 16, a liquid storage container and/or meter 18 and a gas-operated valved purge pump 20. The gas-operated valved purge pump 20 communicates: (1) with the source of gas under pressure 12 through connecting tubing 16C, the control system 14 and connecting tubing 16A; and (2) with the liquid storage container 18 through outlet tubing 16D.

To pump liquid, the control system 14 alternately pressurizes and depressurizes the gas-operated valved purge pump 20 by connecting it alternately to source of gas under pressure 12 through connecting tubing 16A and 16C from the source of connecting tubing 16 and to atmosphere through the vent tube 16E. With this arrangement, liquid is pumped through the outlet tubing 16D into the liquid storage container and/or meter 18. The control system 14 may be a manual valve or equipment such as that referred to in U.S. Pat. No. 4,810,172 or any other manual or automatic source for alternately pressurizing the conduit 16B and releasing pressure through the conduit 16B.

In the preferred embodiment, the gas-operated valved purge pump 20 has a diameter of approximately 44 millimeters and a length of approximately 1.2 meters. It operates on a gas pressure substantially within the range of 20 pounds per square inch and 120 pounds per square inch.

Figure 2:
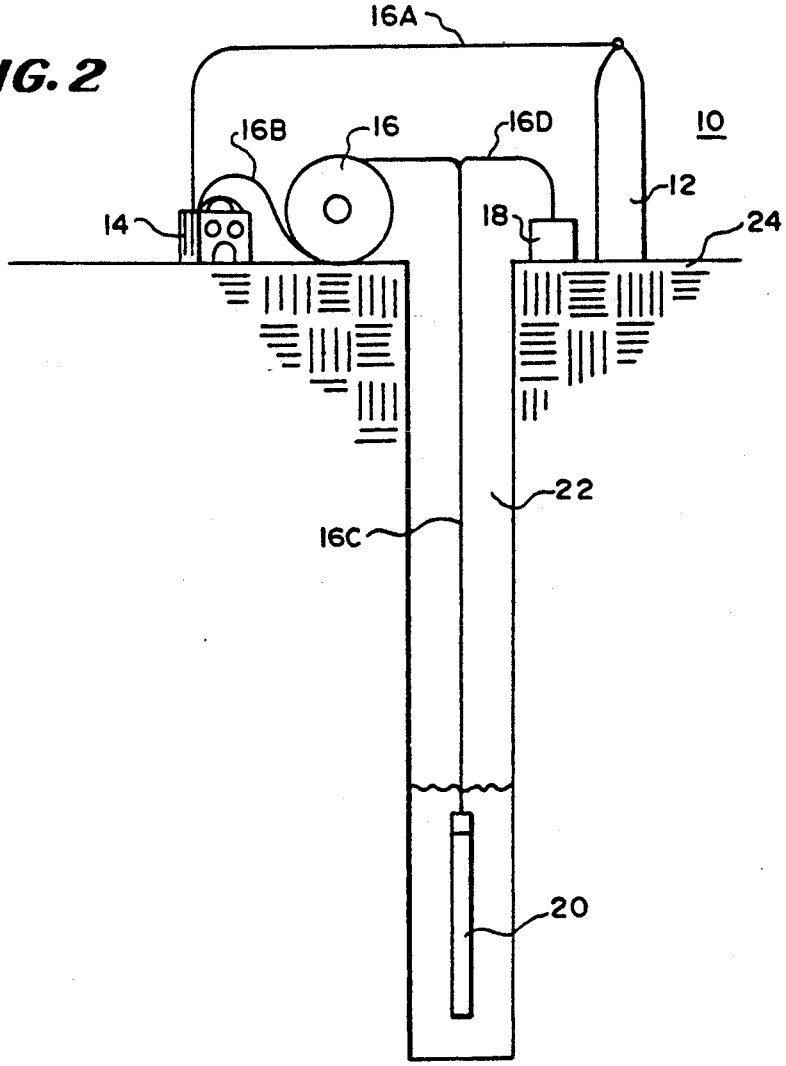
FIG. 2 is a schematic diagram showing one manner in which the pumping system of FIG. 1 is utilized.

In FIG. 2, there is shown a schematic diagram illustrating one application of the gas-operated valved purge pump 20. In this use of the gas-operated valved purge pump 20, it communicates through the connecting tubing 16 through a control box containing the control system 14 and the connecting tubing 16C to force liquid upwardly from a well 22 to the liquid storage container and/or meter 18 under pressure from a pressurized source of gas 12. With this arrangement, liquid may be pumped from a well 22 under ground 24 such as for purging the well by removing several volumes for sampling the quality of water or for other purposes. While this pump is shown as a well purge pump, it may be used for any other purpose such as for sampling water or for pumping other liquids.

Figure 3:
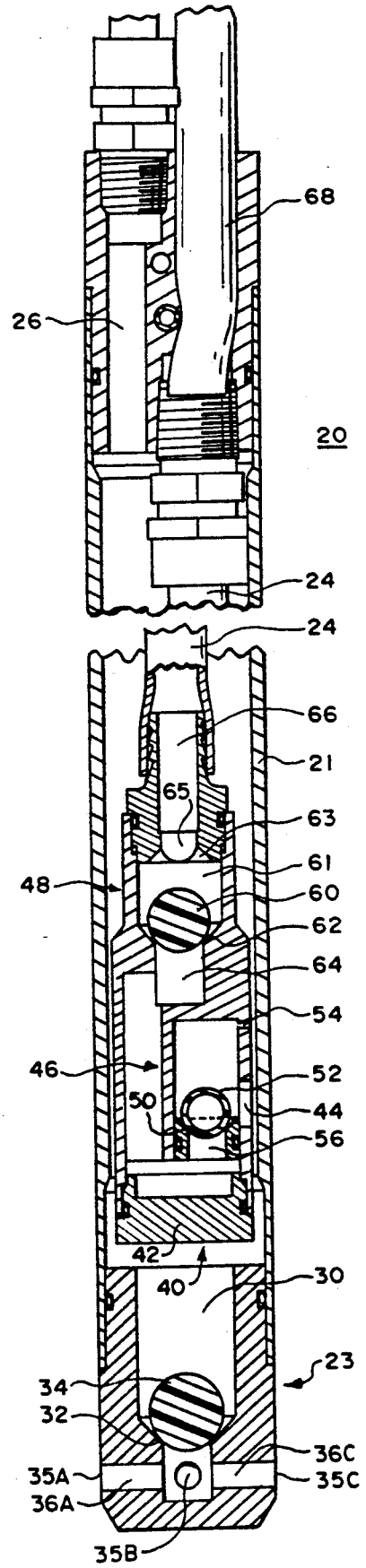
FIG. 3 is a sectional fragmentary view of a pump in accordance with the invention.

In FIG. 3, there is shown a sectional view, partly broken away, of a pump 20 used to evacuate the water such as in a well purging operation, evacuating it several times before taking a sample for environmental monitoring purposes. The pump 20 includes a pump housing 21, a well liquid inlet assembly 23, a flexible standpipe 24, an air conduit 26, and a standpipe valve assembly 40, as its principal parts.

The standpipe 24 and air conduit 26 communicate with a pump chamber within the pump housing 21 at one end and communicate with the surface at the other end where the air conduit 26 may have pressurized gas applied to it periodically to pressurize the pump chamber. As the pump chamber is pressurized, liquid within it is pumped through the standpipe 24 from the chamber of the pump and forced upwardly to the surface. Liquid to be pumped enters the chambers of the pump through the well liquid inlet assembly 23.

The well liquid inlet assembly 23 conforms to the inner shape of the pump housing 21 and fits therein. It includes: (1) four aligned inlet ports, three of which are shown in FIG. 3 at 35A–35C; (2) four passageways, two of which are shown at 36A and 36C respectively; (3) a water check valve assembly having a valve seat 32 and valve element 34 positioned so that the inlet ports and passageways communicate with the valve seat 32 permitting water to flow upwardly beyond the valve element 34 and into the purge pump housing 21, but not in the opposite direction outwardly from the pump housing 21. With this arrangement, unless the pump chamber within the pump housing 21 of the pump 20 is pressurized to hold the check valve element 34 downwardly or the chamber is full, liquid may flow through the ports and passageways upwardly through the check valve inlet and into the pump chamber within the pump housing 21.

The standpipe valve assembly 40 communicates with the standpipe 24 at the lower end of the standpipe and lower end of pump chamber within the pump housing 21 of the pump 20. The standpipe valve 40 includes a standpipe inlet plug 42, a standpipe inlet port 44, a liquid sensing valve 46 and a standpipe check valve 48. The plug 42 seals the bottom of a tubular outer wall of the standpipe, which tubular outer wall includes the standpipe inlet port 44 which communicates directly with the liquid sensing valve 46 to permit liquid to flow into the standpipe housing and through the standpipe check valve 48 when water is in the pump housing 21.

While any type of liquid sensing valve may be used, in the preferred embodiment, the liquid sensing valve 46 is a check valve having a valve seat 50, a valve member 52, a vent port 54 and an outlet port 56. The valve seat 50 is located slightly below the level of the inlet port 44 and the valve element 52 is positioned in a valve cage between the vent port 54, the inlet port 44 and the valve seat 50 so that: (1) when the valve element 52 is against the valve seat 50, it blocks outlet port 56 leading to the standpipe, but liquid may pass through the inlet port 44 and the vent port 54; but (2) when raised from the valve seat 50, the valve element 52 moves upwardly forcing liquid out of the vent port 54 when it is above the inlet port 44 and permits fluid to enter the inlet port 44 and flow downwardly through the valve seat 50 and the outlet port 56 into the standpipe. The vent port 54 and the space between the valve element 52 and cage walls are large enough to permit liquid to escape from between the valve element 52 and the upper portion of the cage walls in sufficient quantity so that the volume of liquid above the valve element 52 is reduced to allow the valve element 52 to move upwardly away from the valve seat 50.

The valve element 52 is less dense than water or any other liquid that the pump is intended to pump. Consequently, when liquid flows into the vent port 54 and against the inlet port 44, the valve element 52 floats upwardly and the liquid can flow downwardly through the valve seat 50 and outlet port 56 into the standpipe. On the other hand, when the gas flows downwardly, the valve element 52 is more dense than the gas and it drops against the valve seat 50 blocking the outlet port 56 so that the liquid cannot flow through the outlet port 56 but can flow through the vent port 54. The cage member is solid and water tight except for the vent port 54 to the interior of the pump housing 21, the inlet port 44 and the outlet port 56 and only the outlet port 56 communicates with the standpipe. The valve element 52 and the inlet to the valve cage are both above the valve seat and valve opening but the valve opening communicates with the stand pipe that extends upwardly above the valve element, valve seat and valve opening.

The valve element 52 must be sufficiently light to float free when the pump 20 is first inserted in a well and there is air in the conduit leading from the valve seat 50 up through the opening 66, the standpipe 24 and conduit 68 to the surface. In the preferred embodiment, the valve element 52 is a hollow polypropylene sphere $\frac{3}{4}$ inch in diameter which has an average specific gravity of 0.5 but it should be lower than 0.8 to permit fast enough floating of the valve element as the pump is lowered so that the valve element is not held on the valve seat against the force of its buoyancy by the head of pressure from the well before the conduit is full of water. If an arrangement is made to fill the conduit leading from the valve seat 50 to the surface of the water in the well, then the average specific gravity need only be less than one. In the preferred embodiment, the diameter of the valve opening 56 is ⅜ of an inch and the valve element 52 rises sufficiently to break the seal when the water line is ⅜ of an inch above the portion of the valve element 52 that forms a seal blocking the valve opening 56.

The check valve 48 is mounted in series between the outlet of the standpipe and the liquid sensing valve 46. It includes in the preferred embodiment a valve element 60, a valve seat 62, a valve inlet port 64 communicating with the opening 66 of the standpipe 24 which, in turn communicates with the conduit 68. The valve cage 61 that communicates with the opening 66 of the standpipe 24 has milled away portions 63 to enlarge the opening 66 for smooth flow and yet provide stops 65 for the check valve element 60.

The outlet port 56 of the liquid sensing valve 46 is connected by a vertical opening to the valve inlet port 64 of the check valve assembly 48. This valve inlet port 64 permits liquid to flow through the valve seat 62, with the valve element 60 being adapted to fit within the valve seat 62 so that when liquid flows through the liquid sensing valve 46 upwardly, it may flow through the check valve assembly 48 into the opening 66 of the standpipe 24 but water within the standpipe forces the valve element 60 into the valve seat 62 by its weight to prevent downward flow.

Figure 4:
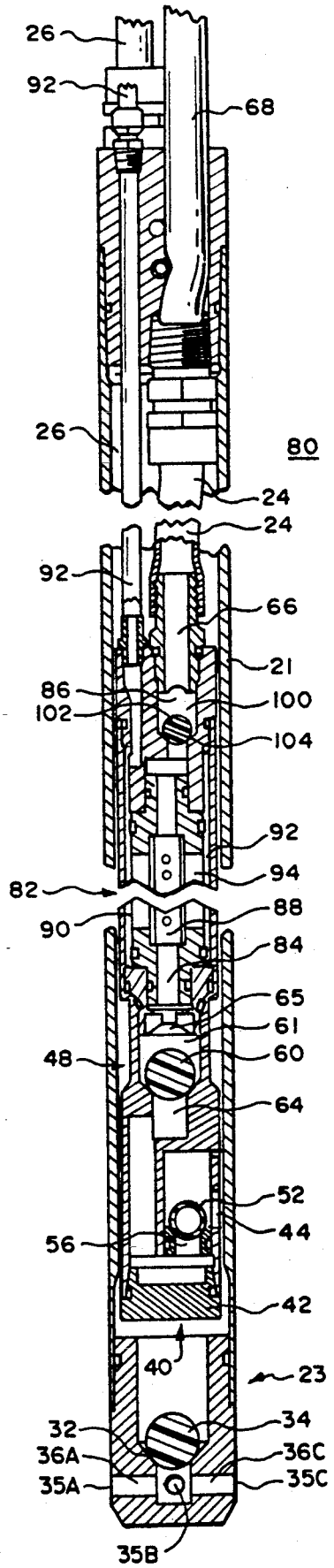
FIG. 4 is a sectional fragmentary view of another embodiment of pump in accordance with the invention.

In FIG. 4, there is shown a longitudinal sectional view of another embodiment of pump 80 similar to the embodiment of FIG. 3 and incorporating substantially the same identical parts, indicated by the same numbers in FIG. 4 as in FIG. 3, but also including within it a bladder pump 82 for drawing samples. The bladder pump 82 is positioned in series with the purge pump within the housing wall 21 and may be located above or below the purge pump either between the inlet assembly 23 and the purge pump or between the purge pump and the opening 66 of the standpipe 24 so that liquid flows through both the purge pump and the bladder pump 82. It includes a central passageway so that liquid flows between the inlet assembly 23 and the standpipe 24 regardless of whether the purge pump is forcing the liquid upwardly or the bladder pump 82 is forcing the liquid upwardly.

The bladder pump 82 includes, in the preferred embodiment, an inlet 84, an outlet 86, a center passage support 88, a bladder 90, an air conduit 92, and a pump chamber 94. In this embodiment, the bladder pump inlet 84 communicates with the outlet 65 of the purge pump and the bladder pump outlet 86 communicates with the opening 66 of the standpipe 24 so that fluid pumped under air pressure through the purge pump flows upwardly through the center passage support 88 within the cylindrical bladder 90 enclosing the pump chamber 94 and into the standpipe 24.

To cause a sample to be drawn, air under pressure is applied to the air conduit 92 from the surface to force the bladder 90 to stretch inwardly and compress fluid between the check valve 60 and the standpipe 24, thus forcing it upwardly. After forcing fluid upwardly, the air may be relaxed to return the bladder 90 to its larger diameter, at which time fluid flows past a valve 48, causing the check valve 60 to be lifted.

To prevent liquid from dropping back into the bladder pump 82, the outlet 86 is closed by another check valve 100 including a valve element 102 within a valve seat 104, which is forced upwardly by liquid flowing into the standpipe 24 but permitted to drop down to seal the valve opening should water in the standpipe 24 be moved in the opposite direction.

This type of bladder pump is not in itself part of the invention, except insofar as it cooperates with the purge pump to permit samples to be drawn immediately after purging without withdrawing one pump and inserting another. It may be operated from the same source of gas under pressure 12 (FIG. 1) as the bladder pump or from a separate source by switching the gas flow from one conduit to another in the case of the use of the same source of gas pressure. While many prior art types of bladder pumps may be used sized appropriately to fit within the housing, it is advantageous for such a bladder pump to have a central support member, such as the cage 88 within the pump chamber 100 to maintain spacing for the flow of fluid. It is also advantageous for the pump to have a relatively large central passageway available during the purge operation.

In both the embodiment of FIG. 3 and the embodiment of FIG. 4, the check valve 52 must be floatable in water and should be capable of floating even though the pump has been newly inserted into a well and contains air within the standpipe 24 all the way down to the valve opening through the valve seat under the valve element 52. For this purpose, the average specific gravity of the valve element 52, with its total volume including any hollow center being divided into its density to reach this average specific gravity, should be sufficiently low so that the buoyancy of the valve in the liquid above the valve element is sufficient to elevate it and break a seal to the valve opening even though there may be air in the valve opening at 56. This specific gravity should be lower than that necessary for the valve element to float unless other arrangements are made for initially breaking the seal the first time the pump is placed in the well, such as by the provision of an opening for flooding the valve seat with water under pressure similar to that exerted by the well water flowing on top of the valve element.

To cause the valve element to break the seal of its own buoyancy, the specific gravity of the valve element should be sufficiently low to enable it to float before liquid entering its cage reaches any surface that enables downward pressure in it by the water. If this is not possible, the specific gravity should be lower or equal to one minus a ratio. The ratio is equal to the depth of the water in the well creating the head of pressure upon its surface multiplied by the area of the valve port divided by the volume of the valve element. The shape of the valve element and opening may vary but in the preferred embodiment, the valve element is spherical and the valve opening cylindrical. Although diameters are being used as the normal parameter for area in this description, because most valve elements are spherical and most valve openings cylindrical, in the case of other shapes such as a square, the parameters used may be the sides of a square or other appropriate dimensions.

During pumping cycles, the pressure is lowered after water has been forced into the standpipe and when water enters the housing, there is water in the valve opening so the element floats free as the water enters.

Although a preferred embodiment of the invention has been described with some particularity, many modifications and variations in the preferred embodiment may be made without deviating from the invention. Therefore, it is to be understood that, within the scope of the appended claims, the invention may be practiced other than as specifically described.

What is claimed is:

1. A combined purge pump and sample pump comprising:

an enclosure;

means for applying a gas under pressure to the enclosure;

inlet means for permitting the flow of liquid under ground from a well into said enclosure;

said inlet means including a check valve means whereby liquid is permitted to flow into said enclosure but not permitted to flow out of said enclosure;

conduit means for permitting liquid to flow out of said enclosure as gas is applied to said enclosure;

said conduit means including an inlet portion;

said inlet portion including a liquid level sensing means for permitting liquid to flow from said enclosure into said conduit means when a substantial amount of liquid is within said enclosure;

said inlet portion including check valve means for permitting liquid to flow into said conduit means but preventing gas from flowing into said conduit means;

said conduit means including a check valve positioned to prevent liquid from flowing from said conduit means into said enclosure;

said conduit extending between said enclosure and the surface of the ground;

said liquid level sensing means including valve means having a valve element and a valve seat;

said valve element having a density less than said liquid but more than said gas, whereby said valve element floats free of said valve seat in the presence of said liquid but not in the presence of said gas;

a sample pump within said enclosure of said combined purge pump and sample pump;

said sample pump being gas operated, whereby samples may be pumped to the surface using a source of gas after a well has been purged by said first-mentioned combined purge pump and sample pump.

2. A combined purge pump and sample pump in accordance with claim 1 in which said sample pump is a bladder pump having a liquid channel flowing therethrough.

3. A combined purge pump and sample pump in accordance with claim 2 in which said sample pump has an inlet and an outlet;

said inlet communicating with the inlet means of said combined purge pump and sample pump and said outlet communicating with said conduit means.

4. A combined purge pump and sample pump in accordance with claim 3 in which said conduit means is a standpipe means.

5. A combined purge pump and sample pump in accordance with claim 4 in which said valve element has a specific density lower than 0.8.

6. A combined purge pump and sample pump in accordance with claim 1 in which the combined purge pump and sample pump is intended to be dropped to a predetermined level under water where the valve is to open and the valve element has a specific density and size and the valve opening is dimensional so that the specific density is at least as low as one minus a ratio having a numerator equal to the level under water multiplied by the area of the valve opening and the denominator is equal to the volume of the valve element.

7. A method of obtaining samples of water from a well bore comprising the steps of:

dropping a single combined purge pump and sample pump down a well bore, wherein the purge pump and sample pump are separately driven;

permitting water to enter the enclosure through a check valve;

automatically opening a path between an enclosure and an outlet conduit when there is a predetermined amount of water in the enclosure and closing the path when there is an amount of water less than said predetermined amount;

pumping water through a check valve into a sample pump section of the combined purge pump and sample pump from the enclosure and from a sample pump section into the outlet conduit by air pressure when the path is open and terminating the pumping when it is closed;

continuing the pumping from said enclosure until the well bore has been emptied at least one time wherein water fills the sample pump section and the conduit, and the water is held therein by the check valve between the enclosure and the sample pump portion;

actuating the sample pump section to pump water after the well bore has been operated and collecting the sample.

8. A method according to claim 7 in which the step of automatically opening a path includes the step of floating a valve element in water within the enclosure when it reaches a certain height and permitting the valve element to fit into a valve seat and break the path when the water in the enclosure drops below said predetermined level.

* * * * *